US011154128B2

(12) United States Patent
Hinkle

(10) Patent No.: US 11,154,128 B2
(45) Date of Patent: Oct. 26, 2021

(54) STORAGE CONTAINER WITH AN INTEGRATED MAT

(71) Applicant: Adam Hinkle, Spring Grove, IL (US)

(72) Inventor: Adam Hinkle, Spring Grove, IL (US)

(73) Assignee: Broadway Pine Brands LLC, Seattle, WA (US)

( * ) Notice: Subject to any disclaimer, the term of this patent is extended or adjusted under 35 U.S.C. 154(b) by 316 days.

(21) Appl. No.: 16/528,810

(22) Filed: Aug. 1, 2019

(65) Prior Publication Data

US 2019/0350349 A1 Nov. 21, 2019

Related U.S. Application Data

(60) Provisional application No. 62/801,131, filed on Feb. 5, 2019.

(51) Int. Cl.

| | |
|---|---|
| ***B65D 77/00*** | (2006.01) |
| ***A45F 4/02*** | (2006.01) |
| ***A45C 9/00*** | (2006.01) |
| ***B65D 25/28*** | (2006.01) |
| ***B65D 25/02*** | (2006.01) |
| *A45C 7/00* | (2006.01) |

(52) U.S. Cl.

CPC ..... *A45F 4/02* (2013.01); *A45C 9/00* (2013.01); *B65D 25/02* (2013.01); *B65D 25/28* (2013.01); *A45C 2007/0004* (2013.01)

(58) Field of Classification Search

CPC ..... B65D 25/02; A45C 2007/0004

USPC ..... 206/216, 575, 579; 141/314, 319; 446/491

See application file for complete search history.

(56) References Cited

U.S. PATENT DOCUMENTS

| | | | | |
|---|---|---|---|---|
| 4,020,922 | A * | 5/1977 | Klasel | B01D 35/31 184/1.5 |
| 5,213,141 | A * | 5/1993 | Dorman | B65F 1/0006 141/10 |
| 5,439,109 | A * | 8/1995 | McBride | A45C 7/0077 174/135 |
| 8,060,969 | B2 * | 11/2011 | Jones | A47L 13/16 15/105 |
| 8,490,238 | B2 * | 7/2013 | Sohn | A47K 10/02 15/209.1 |
| 2008/0017529 | A1 * | 1/2008 | Herring | B65D 5/42 206/216 |
| 2008/0264808 | A1 * | 10/2008 | Gostt | A47L 19/00 206/216 |
| 2010/0234819 | A1 * | 9/2010 | McGarity | B65F 1/0006 604/317 |

* cited by examiner

*Primary Examiner* — Luan K Bui

(74) *Attorney, Agent, or Firm* — Ference & Associates LLC

(57) ABSTRACT

Embodiments of the present invention discloses a storage container with an integrated mat. The storage container includes a receptacle for holding various objects (Eg. toys, crafts, games), and the mat is foldably storable inside the container, wherein the mat is configured in a way such that the mat can be pulled out of the container for performing various activities using the objects, and once done, the objects can be rolled back into the storage container with great ease.

20 Claims, 11 Drawing Sheets

STORAGE CONTAINER WITH AN INTEGRATED MAT

CROSS-REFERENCE TO RELATED PATENT DOCUMENTS

This patent application claims the benefit of priority of U.S. Provisional Application No. 62/801,131, entitled "STORAGE CONTAINER WITH AN INTEGRATED MAT," filed Feb. 5, 2019, which are hereby incorporated herein by reference in its entirety.

TECHNICAL FIELD OF INVENTION

This invention relates generally to storage devices and, particularly, to a storage container with an integrated mat. More specifically, the present invention discloses a storage container for holding various objects (Eg. toys), and a mat foldably storable inside the container, wherein the mat is configured in a way such that the mat can be pulled out of the container for performing various activities using the objects, and once done, the objects can be rolled or slide back into the storage container with great ease.

BACKGROUND

Containers with various shapes and sizes for holding toys, games and/or other objects are known. Also, mats of various sizes and configurations that help kids to play using the toys, games and/or other objects (Eg. crafts material) are known. These containers and mats lack a combination feature that make them a single integrated product for ease of usability.

It is well known that many toys, games and building sets for children can have hundreds of small parts and components. Often times these parts can become scattered and lost when children dump containers full of such parts out on a floor and begin paying and building construction projects. Sometimes such parts end up in traffic areas where they can be stepped on and cause injuries. The invention disclosed herein provides an expandable mat affixed to the container that becomes a play area where toys can be corralled and prevented from being lost.

In the past, several inventors have proposed convertible containers that can serve the purpose of storage for such articles/objects, and an activity mat. For example, U.S. Pat. No. 8,714,389 describes about a convertible device that converts between an activity mat and a storage container to capture and store numerous articles. As an essence, this patent discloses a collapsible storage container that is convertible into an activity mat and convertible back into the storage container whereby the articles used on the activity surface are automatically captured as the sections of the activity mat rise to form the walls of the container.

Further, U.S. Pat. No. 6,146,238 discloses a foldable toy storage container. As described in the patent, the container includes a base member, side members and a top member hinged together to from the container for storage. According to the patent, the base member, side members and top member are movable between a first position forming a box-shaped toy storage container and a second position forming a flat substantially rectangular play area.

Likewise, there are many other references such as U.S. Pat. No. 9,084,459, FR2656992, and KR101234153 that discloses about convertible containers that can serve the purpose of storing various objects or toys, and an activity mat for the users using those objects or toys.

Although several attempts are made in the past to devise convertible containers that can serve the purpose of storage for the objects or toys, and a mat that the kids can use to play with the objects and toys contained therein, none of the devised containers actually provides a user friendly combination feature.

Hence, there is a need for a storage container with an integrated mat, wherein the storage container can hold various objects (Eg. toys), and a mat foldably storable inside the container, wherein the mat is configured in a way such that the mat can be pulled out of the container for performing various activities using the objects, and once done, the objects can be rolled back into the storage container with great ease.

SUMMARY

According to an embodiment, the storage container with an integrated play mat is provided in the form of a basket with or without a lid. The storage container according to this embodiment includes a receptacle for holding various objects and the integral mat foldably storable inside the container. The mat is configured in a way such that the mat can be pulled out of the container (once the container is opened) for performing various activities by the users (such as a kid) using the objects, and once done, the objects can be rolled back into the storage container with great ease.

According to another embodiment, the storage container with an integrated play mat is provided in the form of a drawstring closure pouch. The storage container according to this embodiment includes a receptacle portion for holding various objects and the integral mat foldably storable inside the container. The mat is configured in a way such that the mat can be pulled out of the container (once the container is opened) for performing various activities by the users (such as a kid) using the objects, and once done, the objects can be rolled back into the storage container with great ease.

According to yet another embodiment, the storage container with an integrated play mat is provided in the form of a backpack. The storage container according to this embodiment includes a receptacle portion in the form of backpack for holding various objects and the integral mat foldably storable inside the container. The mat is configured in a way such that the mat can be pulled out of the container (once the container is opened) for performing various activities by the users (such as a kid) using the objects, and once done, the objects can be rolled back into the storage container with great ease.

These and other features and advantages of the present invention will become apparent from the detailed description below, in light of the accompanying drawings.

BRIEF DESCRIPTION OF DRAWINGS

The foregoing summary, as well as the following detailed description of preferred embodiments, is better understood when read in conjunction with the appended drawings. There is shown in the drawings example embodiments, however, the application is not limited to the specific system and method disclosed in the drawings.

DETAILED DESCRIPTION

Figure 1:
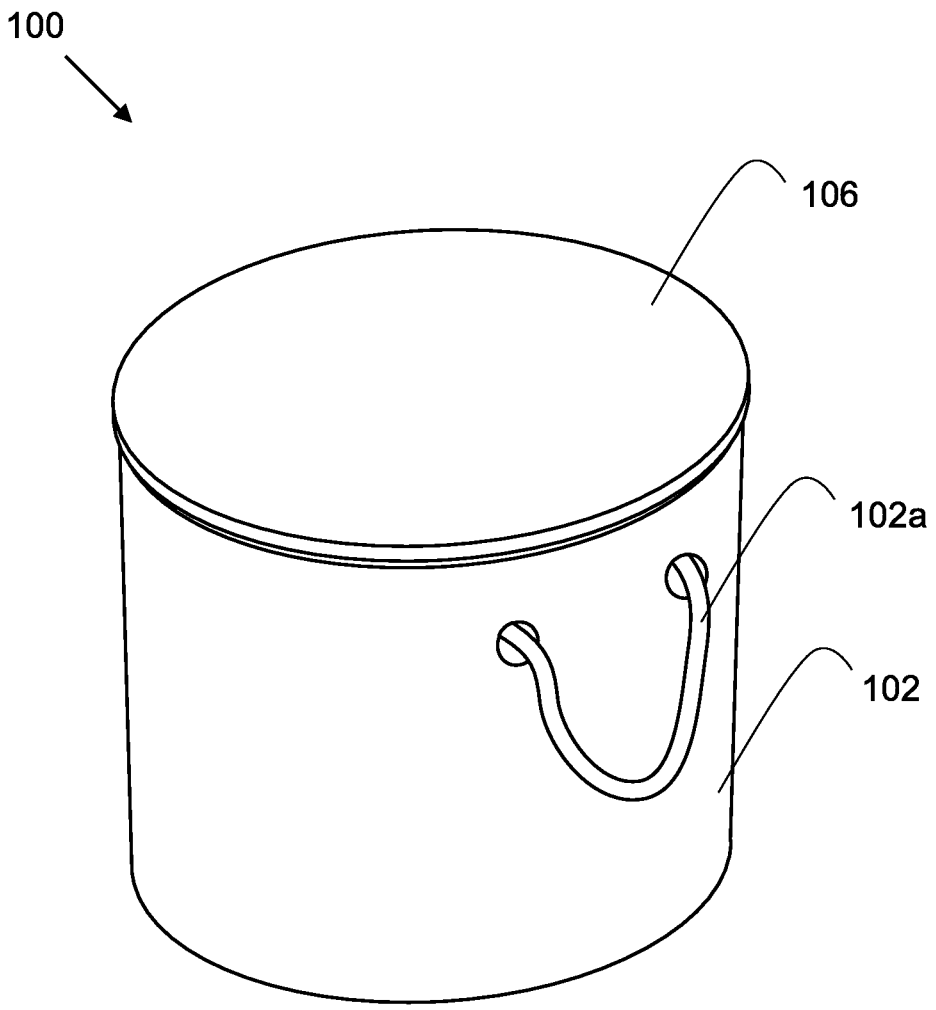
FIG. 1 shows a storage container with an integrated mat in a closed state, according to an embodiment of the present invention.
Figure 2A:
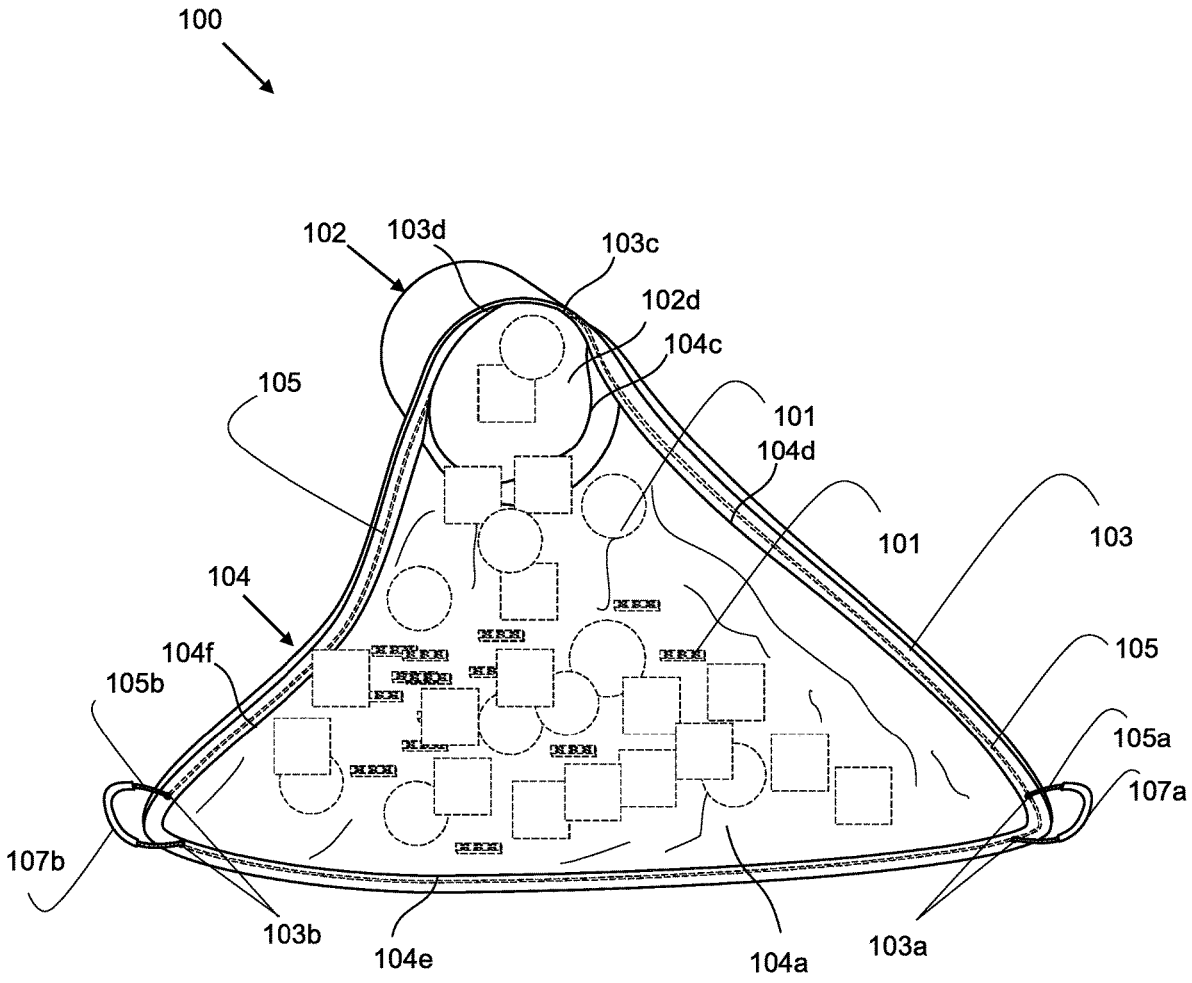
FIG. 2A-2B shows the storage container in an open state with the integrated mat pulled out of the container for performing various activities using various objects contained inside the container, according to an embodiment of the present invention.
Figure 2B:
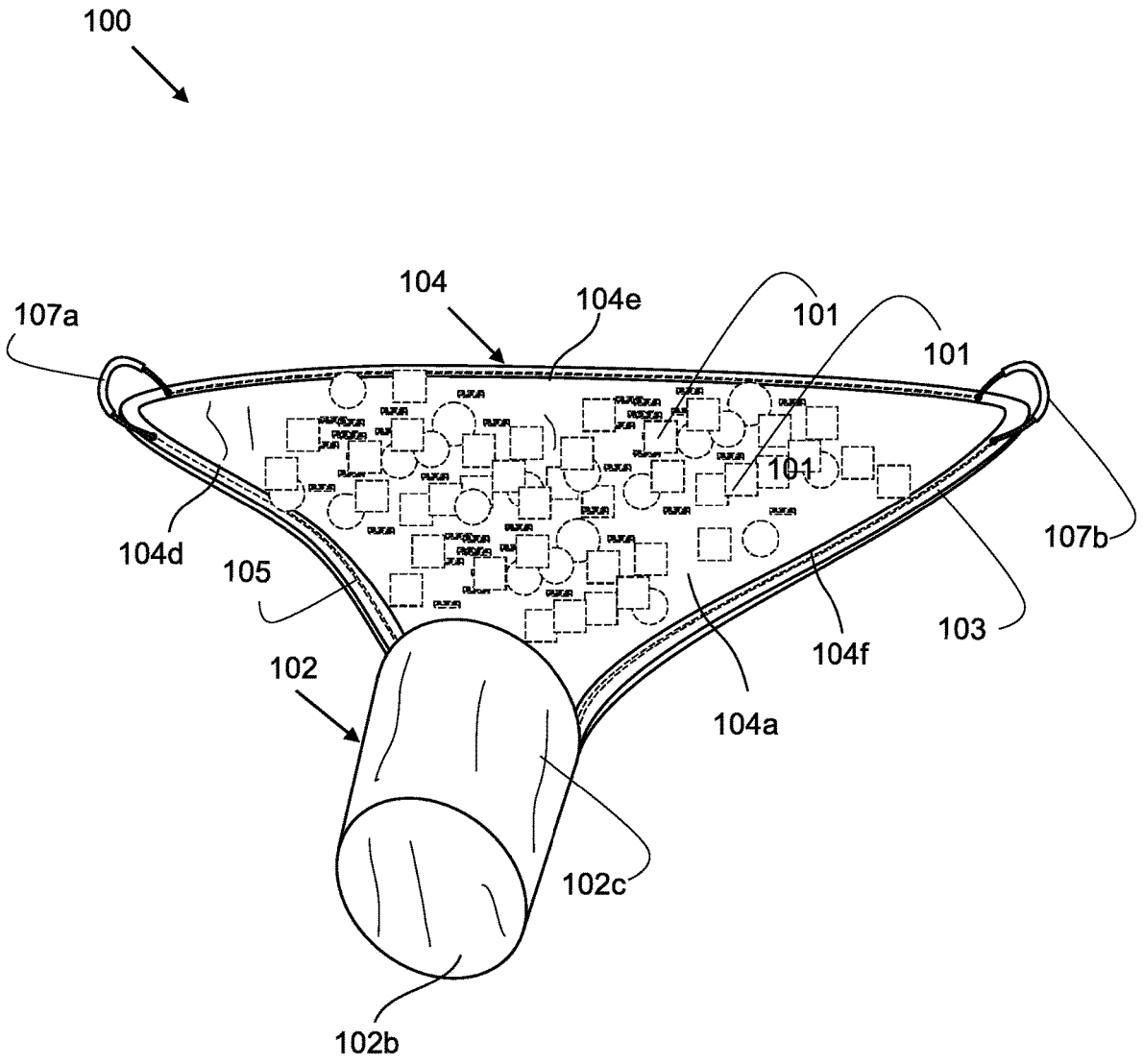

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

References to "one embodiment", "an embodiment", "another embodiment", "an example", "another example", "alternative embodiment", "some embodiment", "yet another embodiment", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment. Unless stated otherwise, terms such as "first", "second", "third", "fourth", are used to arbitrarily distinguish between the elements such terms describe. Thus, these terms are not necessarily intended to indicate temporal or other prioritization of such elements.

In the context of present invention, the term "objects" is broadly used for any articles that can be housed in the container of the present invention, and is able to slide over the integrated mat. The examples include but not limited to toys, crafts material. Further, in the context of the present invention, the term "container" is broadly used to denote means that can store some objects within it, such as baskets, backpacks, pouches etc. In the context of present invention, specifically claims, the wordings extremities and ends are interchangeably used just to arbitrarily distinguish between the elements. Use of such wordings should be regarded as equivalent.

The various features and embodiments of the storage container with an integrated mat 100 are better explained in conjunction with FIGS. 1-10.

Referring to FIGS.1-5, an embodiment of the present invention includes a storage container 100 with an integrated mat. The storage container 100 includes a receptacle 102, a mat 104 integrally connected with the receptacle 102, and a lid 106. According to some other embodiment, the storage container 100 may be configured without the lid 106.

Figure 6:
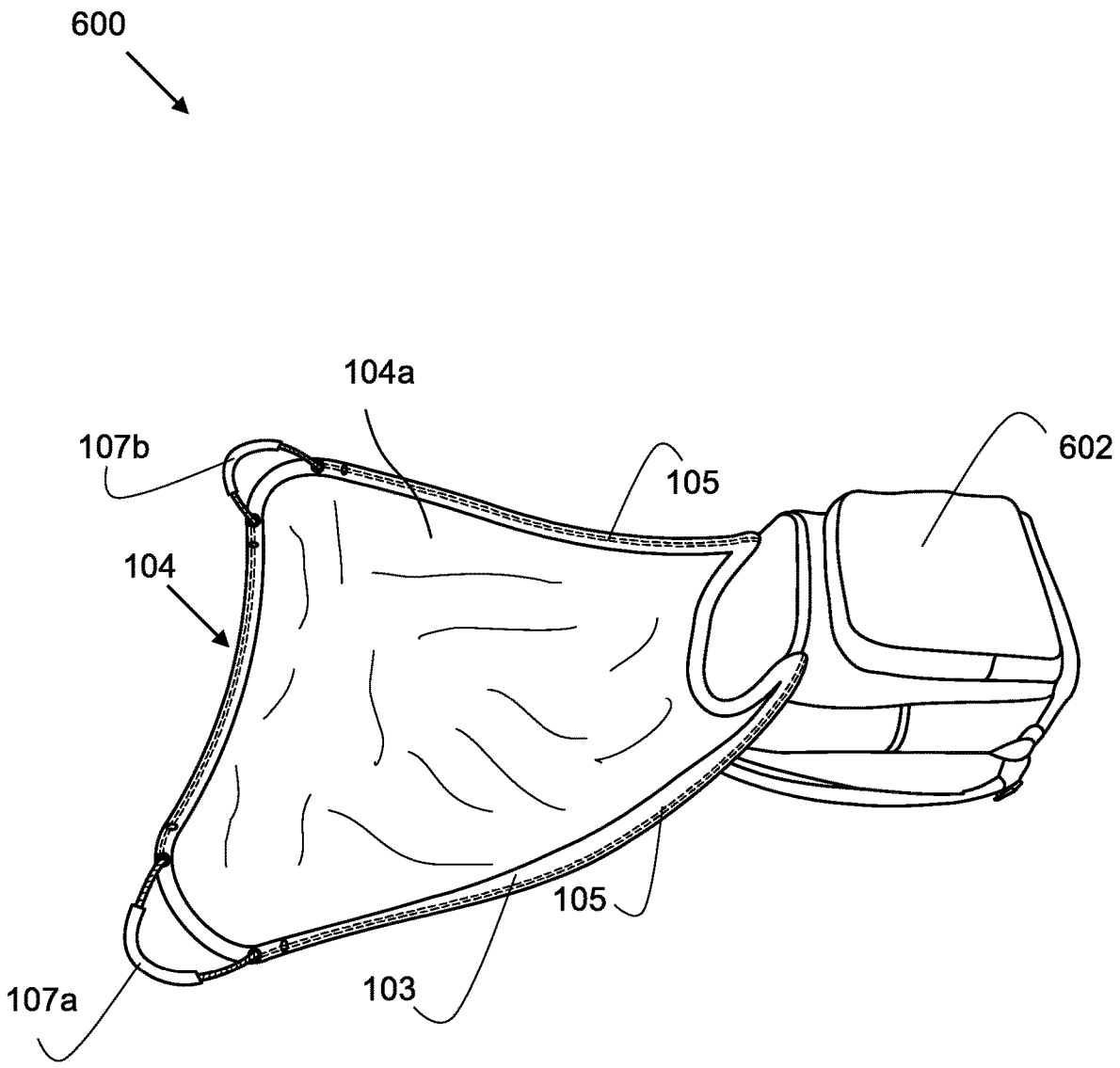
FIG. 6 shows an alternative embodiment of the present invention.
Figure 7:
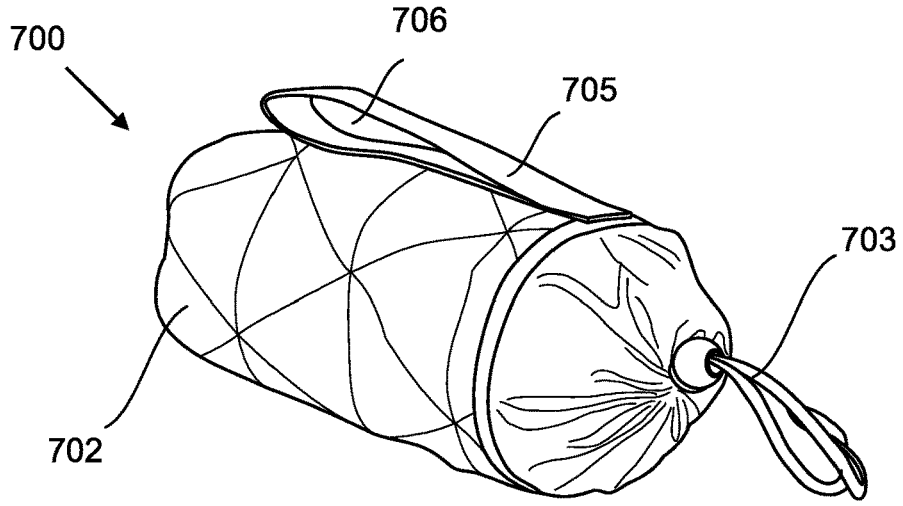
FIG. 7 shows yet another alternative embodiment of the present invention.

The receptacle 102 includes a base 102*b*, side walls 102*c*, and an opening 102*d* with a predefined circumference. The receptacle 102 may preferably be cylindrical or be in other suitable shapes. The receptacle 102 is adapted for holding one or more objects 108. The one or more objects 101 preferably includes but not limited to toys, games, and crafts. According to the embodiment, the receptacle 102 may be provided with a pair of handles 102*a* (although only one is seen visible) for providing assistance in lifting of the container 100. The pair of handles 102*a* are configured on the side walls 102*c* of the receptacle 102. According to an embodiment, the receptacle 102 may be rigid. According to some other embodiment, the receptacle 102 may be collapsible. According to some other embodiment, the receptacle 102 may be a backpack as shown in FIG. 6. According to some other embodiment, the receptacle 102 may in the form of a pouch as shown in FIG. 7.

According to the embodiment, the mat 104 is fixedly connected with the receptacle 102. The mat 104 is flat preferably teardrop shaped and comprises of a top surface 104*a*, and a bottom surface 104*b*, a first end 104*c*, a second end 104*d*, a third end 104*e*, and a fourth end 104*f*. According to some embodiment, the mat 104 may be removably connected with the receptacle 102. In some other embodiments, the mat 104 may be made rectangular, circular, oval, and the like or any other irregular shapes.

The mat 104 further includes a rim 103. The rim 103 may be configured to project upward in a way to form a boundary wall along the perimeter of the mat 104 for retaining the objects 101 dispersed over the top surface 104*a* of the mat 104. This ensures, when the objects 101 are dispersed over the top surface 104*a* of the mat 104 to perform various activities, the objects 101 don't move out of the boundary of the mat 104 easily. The rim 103 includes two ends, namely a first end 103*c* and a second end 103*d*. The rim 103 is disposed along the length of the second end 104*d*, the third end 104*e*, and the fourth end 104*f*. The rim 103 further includes a first set of openings 103*a*, and the second set of openings 103*b*. According to the embodiment, the first set of openings 103*a*, and the second set of openings 103*b* may optionally be provided with grommets. In some other embodiments, any other stopper means that can act or serve the purpose of grommets can also be used. In one embodiment, the rim 103 may be separately sewn or attached along the length of the three ends 104*d*-104*f* of the mat 104. In another embodiment, the three ends 104*d*-104*f* of the mat 104 may itself be folded and sewn to form the rim 103 all around the three ends 104*d*-104*f* of the mat 104.

According to the embodiment, the mat 104, specifically the rim 103 includes a draw string 105 disposed therein. The draw string 105 includes two ends. The draw string 105 is configured to run internally along the length of the rim 103. The two ends of the draw string 105 are fixedly attached to the receptacle 102 at a point where the two ends of the rim 103 attaches the receptacle 102. In some embodiment, the draw string 105 may be configured to run internally partially along the length of the rim 103. The draw string 105 further includes a first portion 105*a*, and a second portion 105*b*. The first portion 105*a* and the second portion 105*b* of the draw string 105 runs outside of the rim 103 for a distance at least equal to the distance between the first set of openings 103*a*, and the second set of openings 103*b* respectively at two sides of the mat 104. The first portion 105*a*, and the second portion 105*b* of the draw string 105 present outside the rim 103 are further provided with a first handle member 107*a*, and a second handle member 107*b*, respectively.

Figure 5:
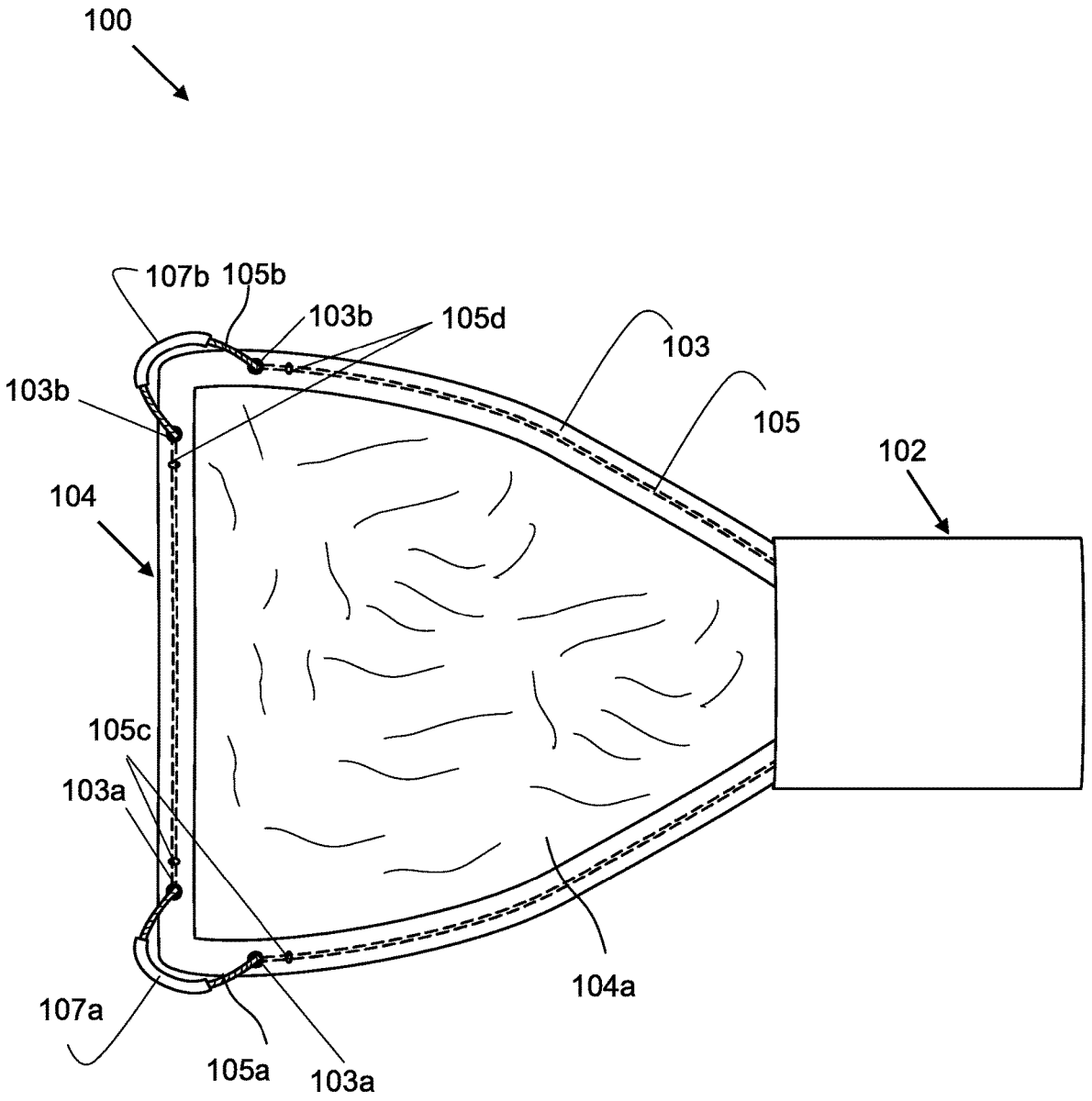
FIG. 5 shows a cross sectional view of the storage container in an open state with the mat pulled out of the container, according to an embodiment of the present invention.

According to the embodiment, the draw string 105 further includes a first set of knots 105*c*, and a second set of knots 105*d* present in the vicinity of the first portion 105*a*, and the second portion 105*b* of the draw string 10 respectively within the rim 103 as shown in FIG. 5. The first set of knots 105*c*, and the second set of knots 105*d* restricts the length of the draw string 105 that can be pulled out of the respective two sets of openings 103*a*, 103*b* respectively. The restriction to the length of the draw string 105 that can be pulled out of the two sets of openings 103*a*, 103*b* facilitates in rolling back of the objects 101 into the storage container 100 or receptacle 102.

According to some other embodiment, the draw string 105 may not include any knots present along its length within the rim 103. According to yet other embodiment, the draw string 105 may include any other suitable means that can be substituted for and can serve as stopper just like the knots 105*c*, 105*d*.

Figure 3A:
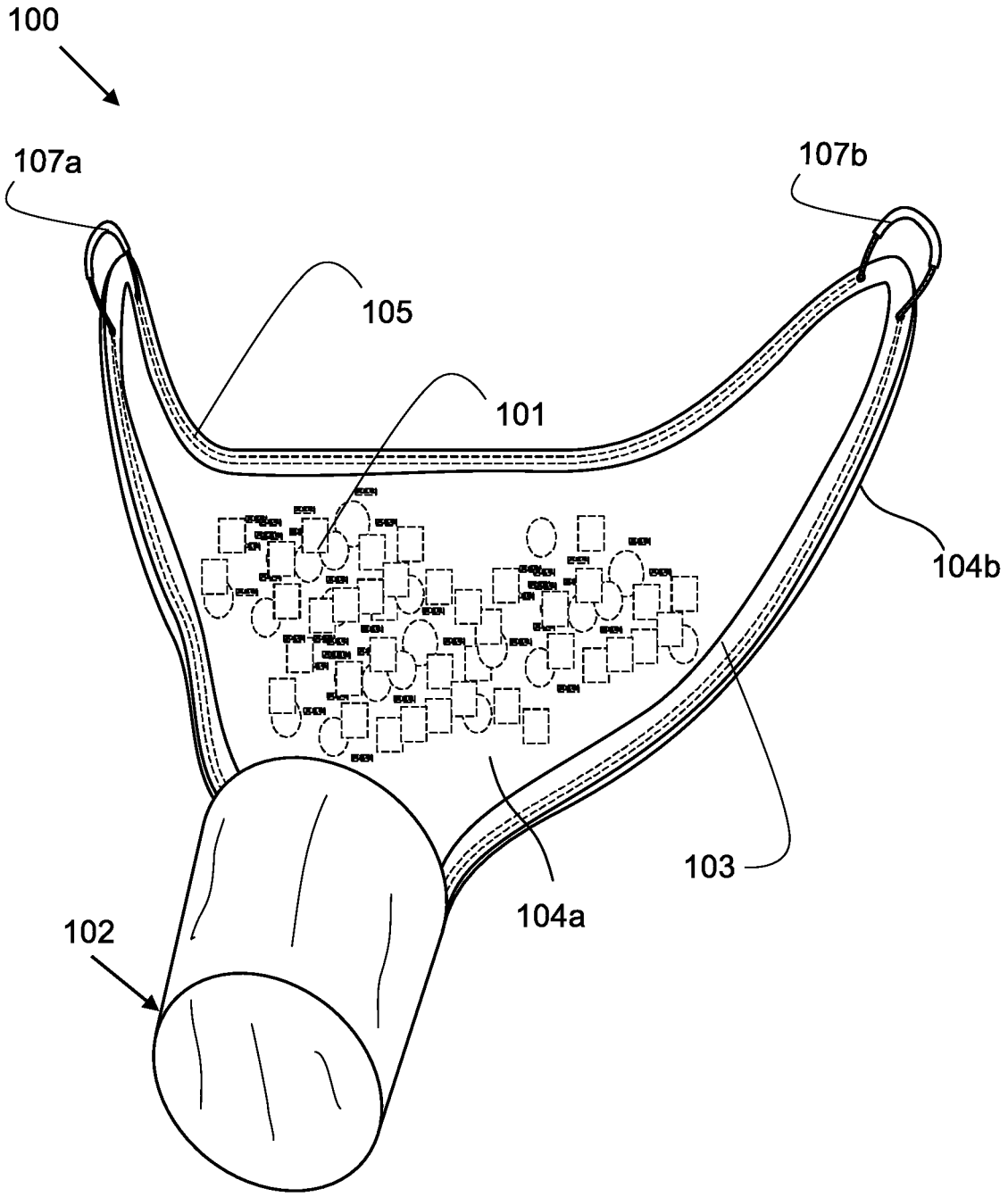
FIG. 3A-3B shows usability of the integrated mat that enables a user to roll back the objects into the storage container, according to an embodiment of the present invention.
Figure 3B:
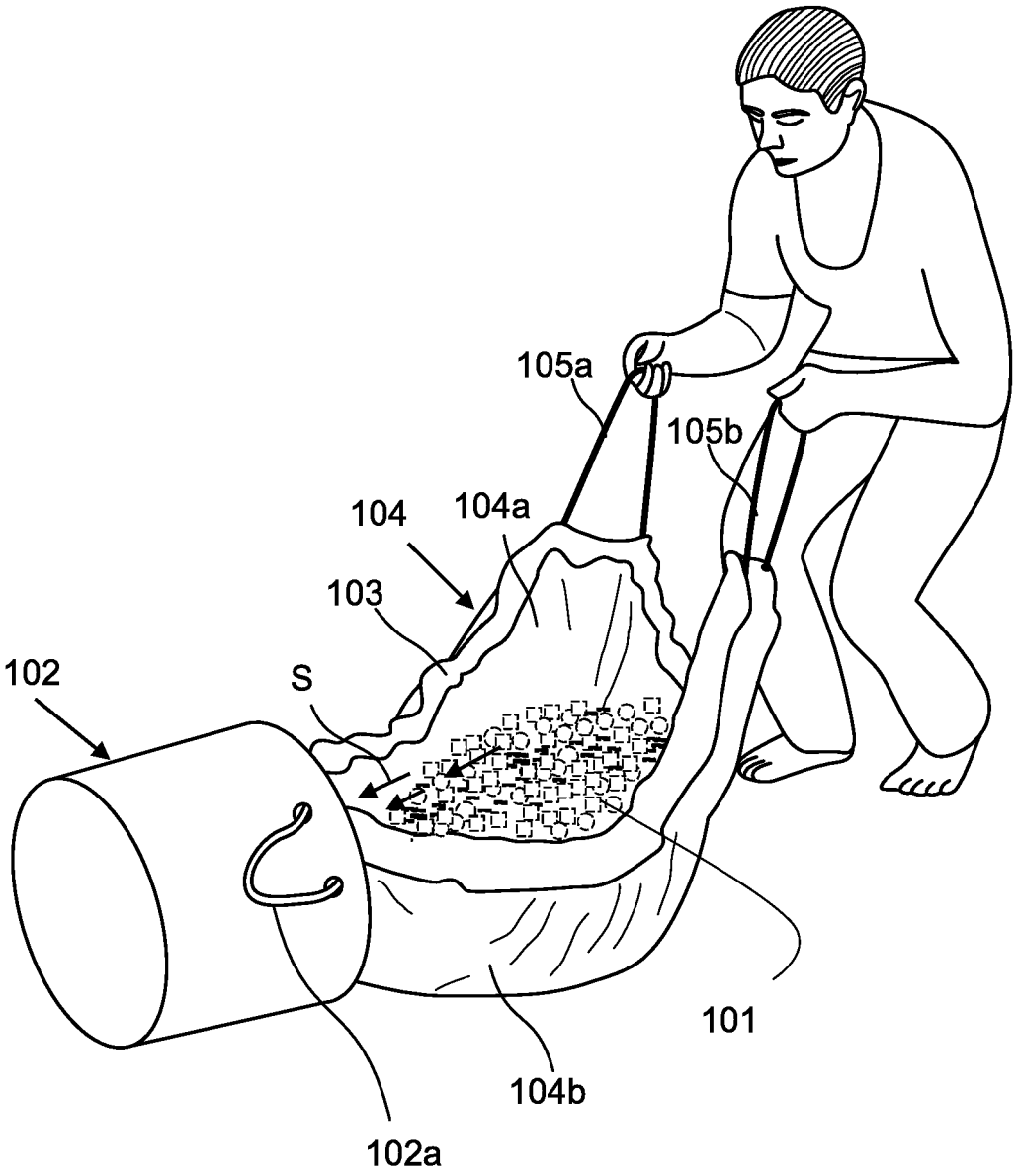
Figure 4:
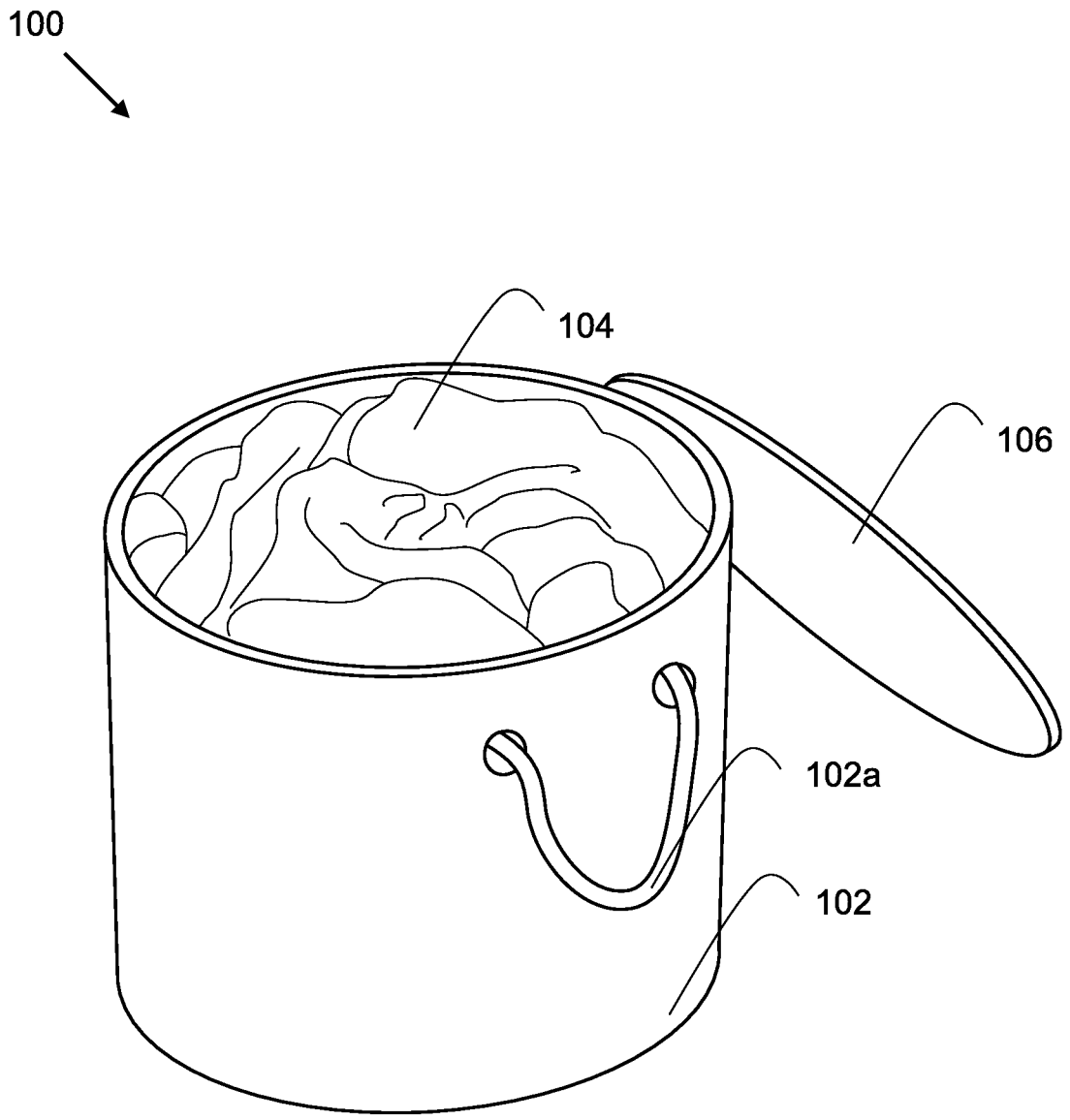
FIG. 4 shows the storage container with a lid in an open state, and the objects and the integrated mat contained inside the container, according to an embodiment of the present invention.

According to the embodiment, the draw string 105 disposed within the rim 103 is configured to augment the shape of the mat 104 so the mat 104 can easily transform from the flat mat 104 to a chute (as shown in FIGS.3A-3B) so that the objects 101 can slide into the receptacle 102.

According to the embodiment, the mat 104 is fixedly connected to a portion along the circumference of the opening 102*d* of the receptacle 102 using the first end 104*c* along with the two ends 103*c*, 103*d* of the rim 103. According to yet other embodiment, the mat 104 may be removably connected to the portion along the circumference of the opening 102*d* of the receptacle 102 using the first end 104*c* along with the two ends 103*c*, 103*d* of the rim 103. The mechanisms known in the art preferably but not limited to a Zipper or a Velcro may be suitably configured at the first end 104*c* of the mat 104 and at the portion of receptacle's circumference to enable the removable connection between the mat 104 and the receptacle 102. The portion along the circumference of the opening 102*d*, where the mat 104 attaches may be ½ of the length of the circumference or ⅔ of the length of the circumference. In some embodiment, even the mat 104 may be attached along the full circumferential length of the opening 102*d* of the receptacle 102.

Referring to FIG. 6, an alternative embodiment of the present invention is shown. As shown, all the components described above with respect to the FIGS.1-5, specifically the mat 104 and associated components, parts thereof such as the draw string 105, the rim 103, and so on are likely be implemented in a similar fashion in this alternative embodiment. The embodiment presented in FIG. 6, discloses an implementation of the described embodiment in the form of a backpack with an integrated mat 600. As seen, basically one can practice the above described invention in the FIGS.1-5 by suitably replacing the receptacle 102 with a backpack 602 known in the art. The implementation shown in FIG. 6 will necessitate changes in terms of mechanism one needs to adapt for interconnecting the mat 104 with the backpack 602 due to the design changes of the receptacle which will be well understood by those skilled in the art.

In operation, when a user (preferably a kid) needs to have an access to the objects 101 contained inside the container 100, the user can open the lid 106 of the container 100. In the example presented, the lid 106 is hingedly connected to the receptacle 102. Once the lid 106 is opened, the user can pull out the mat 104 foldably stored inside the receptacle 102 and deploy the mat 104 over the surface e.g. ground. Once the mat 104 is opened and deployed, the objects 101 are poured out of the receptacle 102 to occupy the top surface 104*a* of the mat 104 in order to perform desired activities. For example, if the users are kids, they can take out the objects 101 such as games, craft items, or toys for playing or for learning purpose.

Further, once the user has completed performing the intended activity with the objects 101 disposed over the top surface 104*a* of the mat 104, the user can with great ease, lift the two handle members 107*a*, 107*b* provided on two sides of the mat 104 which will augment the shape of the mat, changing it to a chute 104 to roll back the objects 101 into the receptacle 102 (as shown in FIG. 3B) and close the container 100 for external storage. The lifting of the two handle members 107*a*, 107*b* provided on the two sides of the mat 104 by the user facilitates the draw string 105 to get pulled out of the two sets of openings 103*a*, 103*b* to a certain length transforming the mat 104 to a chute (transforming the mat 104 into somewhat bowl shaped as shown in FIG. 3B) that causes the objects 101 (present over the mat's top surface 104*a*) to slide/roll in the direction of the receptacle 102 (as indicated by a set of arrows (referenced as 'S') in FIG. 3B).

Figure 8:
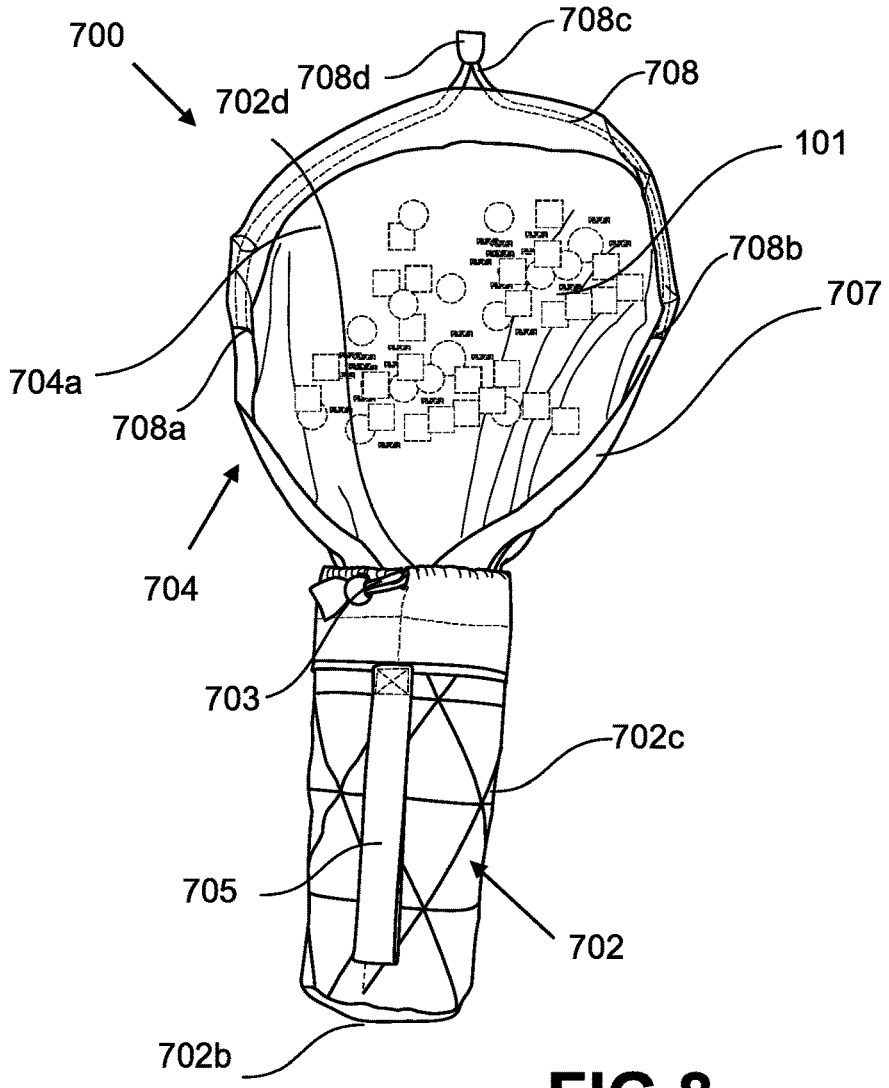
FIG. 8 shows the storage container of FIG. 7 in an open state with the integrated mat pulled out of the container for performing various activities using various objects contained inside the container.
Figure 9:
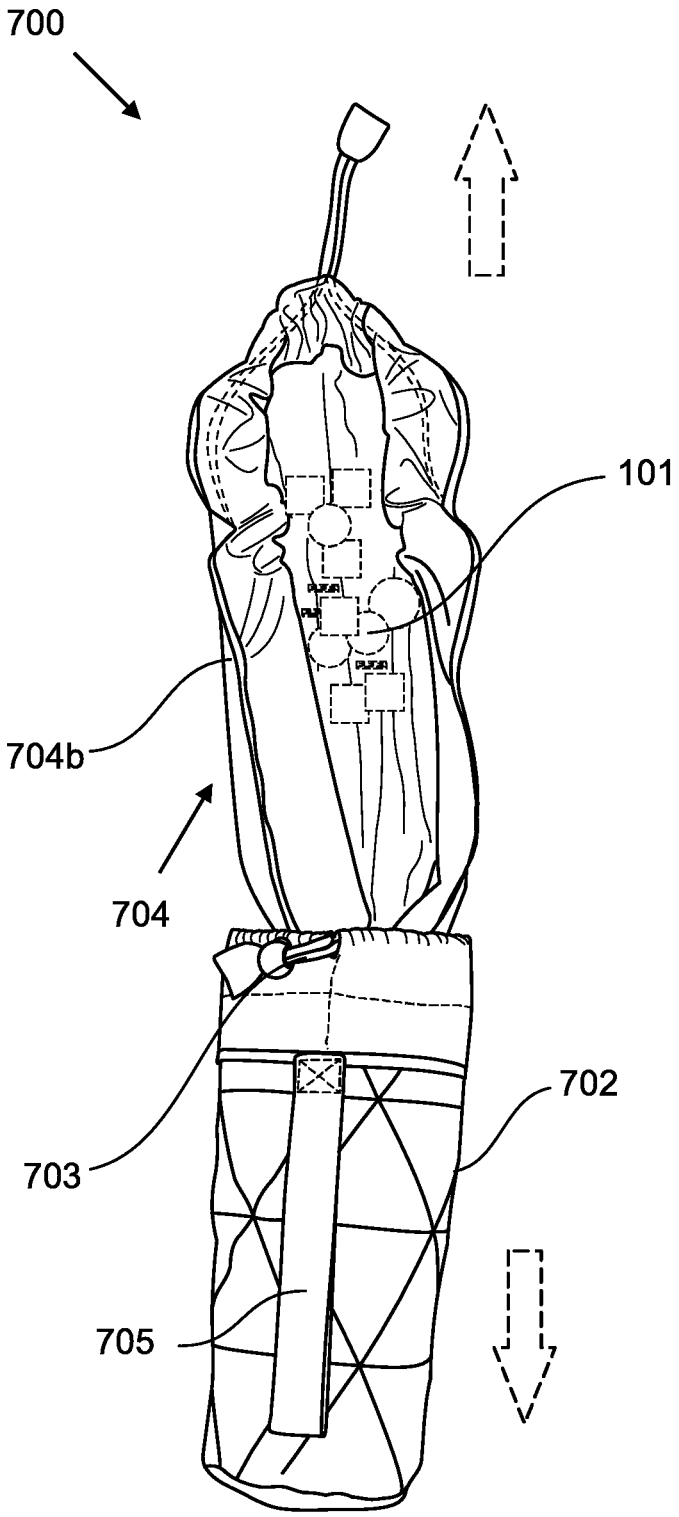
FIG. 9 shows usability of the mat of FIG. 7 that would enable a user to roll or slide back the objects into the storage container.
Figure 10:
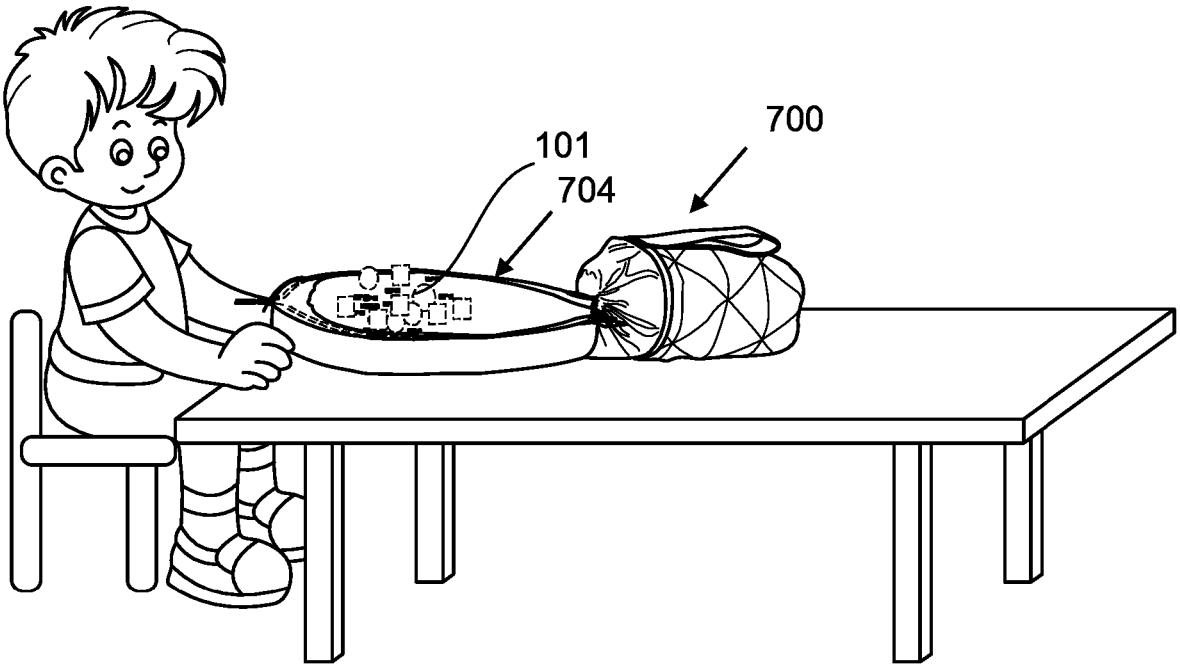
FIG. 10 shows use of the storage container with integrated mat of FIG. 7 by a child, according to an embodiment of the present invention.

Referring now to FIGS. 7-10, there is shown yet another alternative embodiment for a container 700 with an integrated mat. For the purpose of this invention, this embodiment will be referred to as a "table top" version. This table top version is preferably configured to be used by a user or a kid over a table or surface with lesser number of objects as shown in FIG. 10.

FIG. 7 in particular shows the container 700 in a closed state with the mat foldably stored inside the container 700. In the example, the container 700 is shown to be in the form of a drawstring closure pouch. The container 700 includes a receptacle portion 702 for holding various objects therein. The container 700 further includes a pouch handle 705 configured on outer surface/side walls 702*c* of the receptacle 702. The receptacle 702 also includes a base 702*b*, and an opening with a circumference 702*d*. The handle 705 is preferably configured using a strap foldably attached at one end to form a loop 706. This loop 706 may be useful in carrying of the container 700 or even the container 700 can be hung on an object such as a wall using the loop 706. The container 700 in the form of the drawstring closure pouch further includes a drawstring 703 configured around the neck region of the container/pouch 700 to help the user close or open the container 700. This drawstring closure mechanism is well known in the art and thus is not elaborated here for the sake of brevity or clarity of the invention.

FIG. 8 shows the container 700 in an open state with the integrated mat 704 pulled out of the container 700 for performing various activities using various objects (such as toys) contained inside the container 700. Like, the mat's 104 configuration described above with respect to FIGS.1-5, the table top version also comprises the mat 704. The mat 704 may be fixedly connected with the receptacle 702. The mat 704 is flat preferably teardrop shaped and comprises of a top surface 704*a*, and a bottom surface 704*b*, four ends (a first end 104*c*, a second end 104*d*, a third end 104*e*, and a fourth end 104*f*) similar to the mat 104 described above. According to some embodiment, the mat 704 may be removably connected with the receptacle 702. In some other embodiments, the mat 704 may be made rectangular, circular, oval and the like or any other irregular shape. Either fixedly or removably connected, the mat 704 is connected to a portion along the circumference of the opening of the receptacle 702. The mechanisms known in the art preferably but not limited to a Zipper or a Velcro may be suitably configured at the first end of the mat 704 and at the portion of receptacle's circumference to enable the removable connection between the mat 704 and the receptacle 702. The portion along the circumference of the opening, where the mat 704 attaches may be ½ of the length of the circumference or ⅔ of the length of the circumference.

The mat 704 further includes a rim 707 (similar to the rim 103 described above). The rim 707 includes two ends (similar to the ends 103*c* and 103*d* described above with respect to the rim 103). The rim 707 is disposed along the length of the second end 104*d*, the third end 104*e*, and the fourth end 104*f* similar to the rim 103 described above. The rim 707 may be configured to project upward in a way to form a boundary wall along the perimeter of the mat 704 for retaining the objects 101 dispersed over the top surface of the mat 704. This ensures when the objects 101 are dispersed over the top surface of the mat 704 to perform various activities, the objects don't move out of the boundary of the mat 704 easily. Unlike the rim 103, the rim 707 includes one set of openings (not shown). According to the embodiment, the set of openings may or may not be provided with grommets. In some other embodiments, any other stopper means that can act or serve the purpose of grommets can also be used. Also, in some other embodiments, any other stopper means that can act or serve the purpose of grommets can also be used. In one embodiment, the rim 707 may be separately sewn or attached along the length of the three ends 104*d*-104*f* of the mat 704. In another embodiment, the three ends 104*d*-104*f* of the mat 704 may itself be folded and sewn to form the rim 707 all around the three ends 104*d*-104*f* of the mat 704.

According to the embodiment, the mat 704, specifically the rim 707 includes a draw string 708 disposed therein. The draw string 708 includes two ends. The draw string 708 is configured to run internally (or within interior) partially along the length of the rim 707. The two ends of the draw string 708 are fixedly attached at a point within the rim 707. In an example, the two ends 708*a*, and 708*b* of the draw string 708 are preferably attached within the rim 704 about a half way along the length of the rim 704. The draw string 708 further includes a portion 708*c* that runs outside of the rim 707 for a distance at least equal to the distance between the openings present at the third end 104*e* of the mat 704. The portion 708*c* of the draw string 708 present outside the rim 707 may further be provided with a handle or a pull tab 708*d*. The user/kid using the container with the integrated mat 700 can hold this pull tab 708*d*, and the handle 705 together using his/her two hands and apply a pull force in opposite direction (in the direction of dotted arrows) to draw close the mat 704 as shown represented in FIG. 9. When the user applies the pull force in the opposite direction using the handle 705 and the pull tab 708*d*, the mat 704 transforms to a chute (as shown in FIG. 9) so that the objects 101 contained over the top surface 704*a* of the mat 704 can slide or roll back into the receptacle 702.

It should be noted that, the containers 100, or 600, or 700, the mats 104, or 704 and any associated components, parts thereof described above in the FIGS.1-11 with respect to various embodiments may be made of any suitable material known in the art, and be made in different shapes and sizes that may make the presented invention realization in real scenario. It is also possible that different parts or components of the invention may be made of different materials and thus use of material should not be considered as any limitation to the implementation of the present invention.

The preceding description has been presented with reference to various embodiments. Persons skilled in the art and technology to which this application pertains will appreciate that alterations and changes in the described structures and methods of operation can be practiced without meaningfully departing from the principle, spirit and scope of the present invention.

What is claimed is:

1. A storage container with an integrated mat (100), comprising:

a receptacle (102) adapted for holding one or more objects (101), wherein the receptacle (102) comprises of a base (102*b*), side walls (102*c*), and an opening (102*d*) with a predefined circumference;

an integrated mat (104) comprising:

a top surface (104*a*), a bottom surface (104*b*), a first end (104*c*), a second end (104*d*), a third end (104*e*), and a fourth end (104*f*);

a rim (103) having two ends (103*c*, 103*d*), wherein the rim (103) is disposed along the length of the second end (104*d*), the third end (104*e*), and the fourth end (104*f*) of the integrated mat (104);

a draw string (105) having two extremities, wherein the draw string (105) is configured to run internally along the length of the rim (103); and wherein, the integrated mat (104) is connected to a portion of and along the predefined circumference of the opening (102*d*) of the receptacle (102) using the first end (104*c*) along with the two ends (103*c*, 103*d*) of the rim (103).

2. The storage container (100) of claim 1, wherein the one or more objects (101) comprises at least one of toys, games, and crafts.

3. The storage container (100) of claim 1, wherein the two extremities of the draw string (105) fixedly attaches to the receptacle (102) at a point where the two ends (103*c*, 103*d*) of the rim (103) attaches the receptacle (102).

4. The storage container (100) of claim 1, wherein the rim (103) further comprises of a first set of openings (103*a*), and the second set of openings (103*b*) provided with grommets.

5. The storage container (100) of claim 1, wherein the draw string (105) comprises a first portion (105*a*), and a second portion (105*b*) that runs outside of the rim (103) for a distance at least equal to the distance between the first set of openings (103*a*), and the second set of openings (103*b*) respectively at two sides of the integrated mat (104).

6. The storage container (100) of claim 5, wherein the first portion (105*a*), and the second portion (105*b*) of the draw string (105) present outside the rim (103) at the two sides of the integrated mat (104) are provided with a first handle member (107*a*), and a second handle (107*b*), respectively.

7. The storage container (100) of claim 1, wherein the draw string (105) further comprises a first set of knots (105*c*), and a second set of knots (105*d*) present in the vicinity of the first portion (105*a*), and the second portion (105*b*) of the draw string (105) respectively within the rim (103) to restrict the length of the draw string (105) that can be pulled out of the first set of openings (103*a*), and the second set of openings (103*b*) respectively.

8. The storage container (100) of claim 7, wherein the restriction to the length of the draw string (105) that can be pulled out of the first set of openings (103*a*), and the second set of openings (103*b*) facilitates in rolling back of the one or more objects (101) into the receptacle (102) without disturbing the integrity of the container (100).

9. The storage container (100) of claim 1, wherein the rim (103) is configured to project upward in the form of a boundary wall along perimeter of the mat (104) for retaining the one or more objects (101) dispersed over the top surface (104*a*) of the integrated mat (104) to ensure the one or more objects (101) don't move out of the integrated mat (104), while a user perform different activities over the integrated mat (104) using the one or more objects (101).

10. The storage container (100) of claim 1 further comprising a lid (106) configured to be used by the user to open or close the container (100).

11. The storage container (100) of claim 1, wherein the receptacle (102) is configured in the form of at least a rigid basket, a collapsible basket, a backpack, and a drawstring closure pouch.

12. The storage container (100) of claim 1, wherein the receptacle 102 is provided with a pair of handles (102*a*) configured on the side walls (102*c*).

13. The storage container (100) of claim 1, wherein the portion along the predefined circumference of the opening (102*d*) of the receptacle (102), where the integrated mat (104) attaches the receptacle (102) is at least one ½ of the length of the circumference or ⅔ of the length of the circumference, or full length of the circumference.

14. A storage container with an integrated mat (700) configured as a pouch, comprising:

a receptacle (702) adapted for holding one or more objects (101), wherein the receptacle (102) comprises of a base (702*b*), side walls (702*c*), and an opening (702*d*) with a predefined circumference;

a handle (705) configured outside of the side walls (702*c*) of the receptacle (702);

an integrated mat (104) comprising:

a top surface (704*a*), a bottom surface (704*b*), a first end (104*c*), a second end (104*d*), a third end(104*e*), and a fourth end (104*f*);

a rim (707) having two ends (103*c*, 103*d*), wherein the rim (707) is disposed along the length of the second end (104*d*), the third end(104*e*), and the fourth end (104*f*) of the integrated mat (704);

a draw string (708) having two extremities, wherein the draw string (708) is configured to run partially within interior and along the length of the rim (707); and wherein, the integrated mat (704) is connected to a portion of and along the predefined circumference of the opening (702*d*) of the receptacle (702) using the first end (104*c*) along with the two ends (103*c*, 103*d*) of the rim (707).

15. The storage container (700) of claim 14, wherein the rim (707) further comprises a set of openings.

16. The storage container (700) of claim 14, wherein the draw string (708) comprises a portion (708*c*) that runs outside of the rim (707) for a distance at least equal to the distance between the set of openings present at the third end (104*e*) of the mat (704).

17. The storage container (700) of claim 16, wherein the portion (708*c*) of the draw string (708) that runs outside the rim (707) is provided with a pull tab (708*d*).

18. The storage container (700) of claim 17, wherein the knob (708*d*) is used by a user along with the handle (705) configured on the side walls (702*c*) of the receptacle (702) to draw close the integrated mat (704) in order to facilitate rolling back of the one or more objects (101) into the receptacle (702).

19. The storage container (700) of claim 14, wherein the rim (707) is configured in the form of a boundary wall to project upward along perimeter of the mat (704) for retaining the one or more objects (101) dispersed over the top surface (704*a*) of the integrated mat (704) to ensure the one or more objects (101) don't move out of the integrated mat (704), while a user perform different activities over the integrated mat (704) using the one or more objects (101).

20. The storage container (700) of claim 14, wherein the portion along the predefined circumference of the opening (702*d*) of the receptacle (702), where the integrated mat (704) attaches the receptacle (702) is at least one ½ of the length of the circumference or ⅔ of the length of the circumference, or the full length of the circumference.

* * * * *